United States Patent [19]

Quinones et al.

[11] Patent Number: 4,830,031

[45] Date of Patent: May 16, 1989

[54] HAIR COMB ATTACHMENT FOR PRECISE HAIRCUTTING AND TRIMMING

[76] Inventors: Juan A. Quinones; Nancy Quinones, both of 890 NW. 213th La., Bldg. #16, Apt. #303, Miami, Fla. 33169

[21] Appl. No.: 151,161

[22] Filed: Feb. 1, 1988

[51] Int. Cl.[4] ..... A45D 24/34

[52] U.S. Cl. ..... 132/214; 132/148

[58] Field of Search ..... 132/148, 45 R, 45 A

[56] References Cited

U.S. PATENT DOCUMENTS

| | | | |
|---|---|---|---|
| 937,475 | 10/1909 | Sheffield | 132/148 |
| 1,239,951 | 9/1917 | Peckham | 132/45 R |
| 3,638,665 | 0/1972 | Staffas, Sr. | 132/45 A |
| 3,848,611 | 0/1974 | Asard | 132/45 A |
| 3,972,337 | 8/1976 | Pomaro | 132/45 R |
| 4,368,745 | 0/1983 | McGuffey | 132/45 A |
| 4,381,015 | 0/1983 | Harvath | 132/45 R |
| 4,487,211 | 0/1984 | Sullivan | 132/45 R |
| 4,505,283 | 0/1985 | Pischdotchian | 132/45 R |
| 4,520,565 | 0/1985 | Maggiore | 132/45 R |
| 4,619,044 | 0/1984 | Dennis | 132/45 R |

*Primary Examiner*—Gene Mancene
*Assistant Examiner*—Adriene J. Lepiane
*Attorney, Agent, or Firm*—Oltman and Flynn

[57] ABSTRACT

An attachment for a hair comb to be used for cutting and trimming hair to a measured length. It includes at least two elongate legs each having two ends. Each leg has a transverse slot at one end serving to receive the spine of a hair comb. An elongate bottom piece is rigidly joined at each end to the other end of each side leg for spacing the legs apart.

2 Claims, 1 Drawing Sheet

HAIR COMB ATTACHMENT FOR PRECISE HAIRCUTTING AND TRIMMING

BACKGROUND

1. Field of Invention

This invention relates to hair combs, specifically to an attachment used with combs to facilitate precise, even haircutting and trimming.

2. Description of Prior Art

Heretofore, hair combs and home haircutting kits have included combs, scissors, razor type and electric instruments used to facilitate at home haircutting. Previously, no such kit has contained a hair comb attachment to provide accurate, measured haircutting. Most barbers use finger measurement or judge length simply by looking. Unfortunately, for many of use, these techniques do not provide for an accurate, even haircut.

OBJECTS AND ADVANTAGES

Several objects and advantages of the invention are that a home haircutter is provided with a simple and easy-to-use attachment, which can measure the length of hair to be cut and provide an even cut, without the need to guess the length of hair to be cut.

SUMMARY OF THE INVENTION

The invention is an attachment for a hair comb to be used for cutting and trimming hair to a measured length, and includes at least two elongate side legs each having two ends, a transverse slot at the one end for receiving the back of a hair comb and an elongate bottom piece rigidly joined to the other end of each side leg for spacing the legs apart.

The hair comb attachment, when used properly, will measure the hair to the nearest one-eighth of an inch. If different lengths are desired for different parts of the hair, all that need be done is to snap on another comb attachment. The hair comb attachments will come in various sizes ranging from one-quarter of an inch to four inches. Also once a person knows at what length his hair looks best, he simply uses that size hair comb attachment for his haircut.

In further we claim the following additional objects and advantages: to provide a haircutting tool (attachment) which can be used simply and easily that lets a user give him/herself and others at home, haircuts that are even and precise.

The hair attachment allows anyone to give or be given a haircut or trim at home without having to go to a barber shop. This saves time and money for the consumer. The fear of cutting too much or not cutting enough hair will be erased when this haircutting attachment is used properly.

It is made of a semi-hard plastic material, and snaps on to any standard size comb and may be made in various sizes.

Further objects and advantages of our invention will become apparent from a consideration of the drawings and ensuing description of it. Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 1:
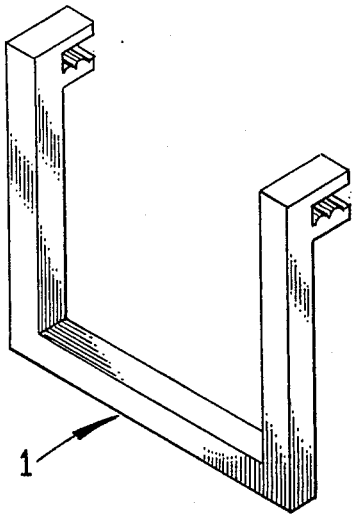
FIG. 1 shows the plastic hair comb attachment according to the invention

FIG. 1 shows a single piece comb attachment according to the preferred embodiment of the invention. The attachment has snap on features which attach to any standard size comb. The attachment is preferably made of semi-hard plastic.

Figure 2:
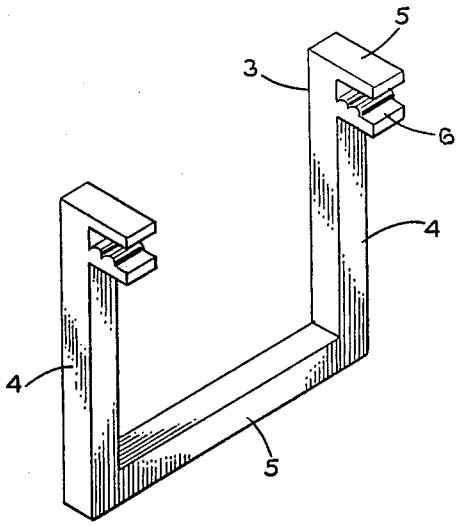
FIG. 2 shows a side view of the comb attachment showing the snap on sections

FIG. 2 shows the comb attachment in more detail. It has two side legs 4, of which each has an upper end 3 with a projection 5 having a transverse indentation or slot 6 therein which serve to receive the spine 7 of a hair omb 2 in a firm fit. The other end of each side leg 4 are rigidly joined to the ends of a bottom piece 5 which serves to maintain the two side legs 4 at a given spacing. The length of the side legs serve to measure hair, and may vary in length from one quarter of an inch to four inches. The bottom piece 5 rests on the scalp during cutting.

Figure 3:
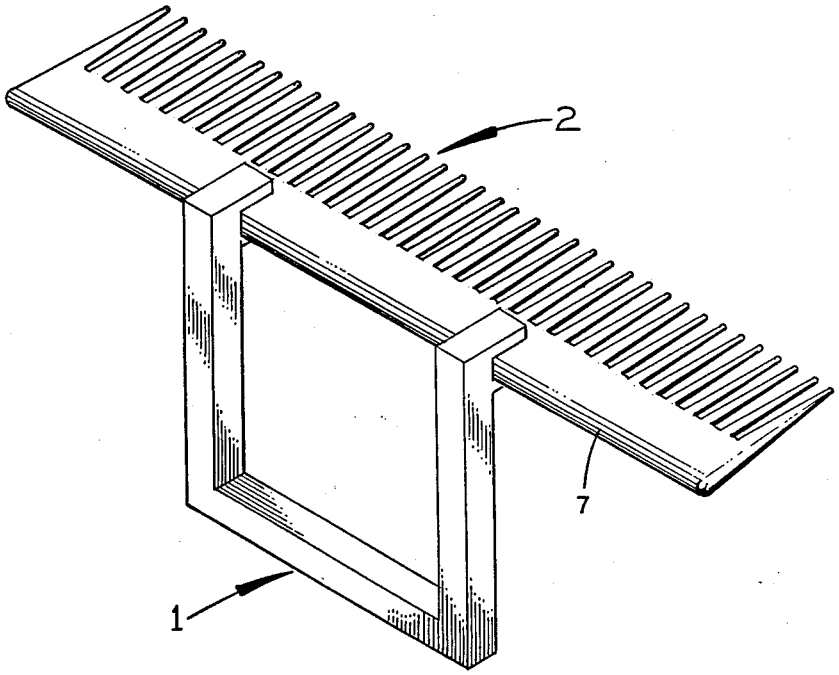
FIG. 3 shows a hair comb attachment snapped on to the standard size comb.

FIG. 3 shows the hair comb attachment as it would look when being used. The comb is in a horizontal position while the hair comb attachment is in a vertical position.

The hair comb attachment is very simple to use by almost anyone. It is simply attached to a standard size comb 2 (FIG. 3). As in the technique most barbers use, a small portion of hair is combed in a straight out direction from the scalp. When doing this, as the comb is going away from the scalp, the comb is turned enough so that the bottom of the hair comb attachment is resting on the scalp next to the roots of the hair being pulled. When this technique is done properly, the part of the hairs that are between the bottom of the hair comb attachment and the and the bottom side of the comb will be measured by the length of the side legs 4 and kept, while the other part of the hairs coming out through the top side of the comb will be cut.

While using the comb attachment the user can observe the hair and scalp through the opening formed by the side legs 4 and bottom piece 5, which is helpful in maintaining visual control of the cutting.

Thus the reader will see that the hair comb attachment provides a highly reliable, economical, easy to attach device that can be used by almost anyone and provide the consumer with a precise even cut or trim, done in one's own home.

The hair comb attachment has been proven to work and to be used by non-professionals. I, Juan A. Quinones used it on myself, wife and child and do state that it saves time, money and gives one the satisfaction of receiving a good haircut.

We claim:

1. In combination a comb having a spine and a hair comb attachment for use in haircutting and trimming comprising: said hair comb attachment having two elongate side legs, each having a first and a second end, the first end forming a transverse slot, the spine of said hair comb positioned therein, and an elongate bottom piece rigidly joined at each end to a respective second end of said side legs for performing precision cutting and trimming of hair.

2. A hair comb attachment according to claim 1, wherein said attachment is formed of molded plastic.

* * * * *